United States Patent [19]

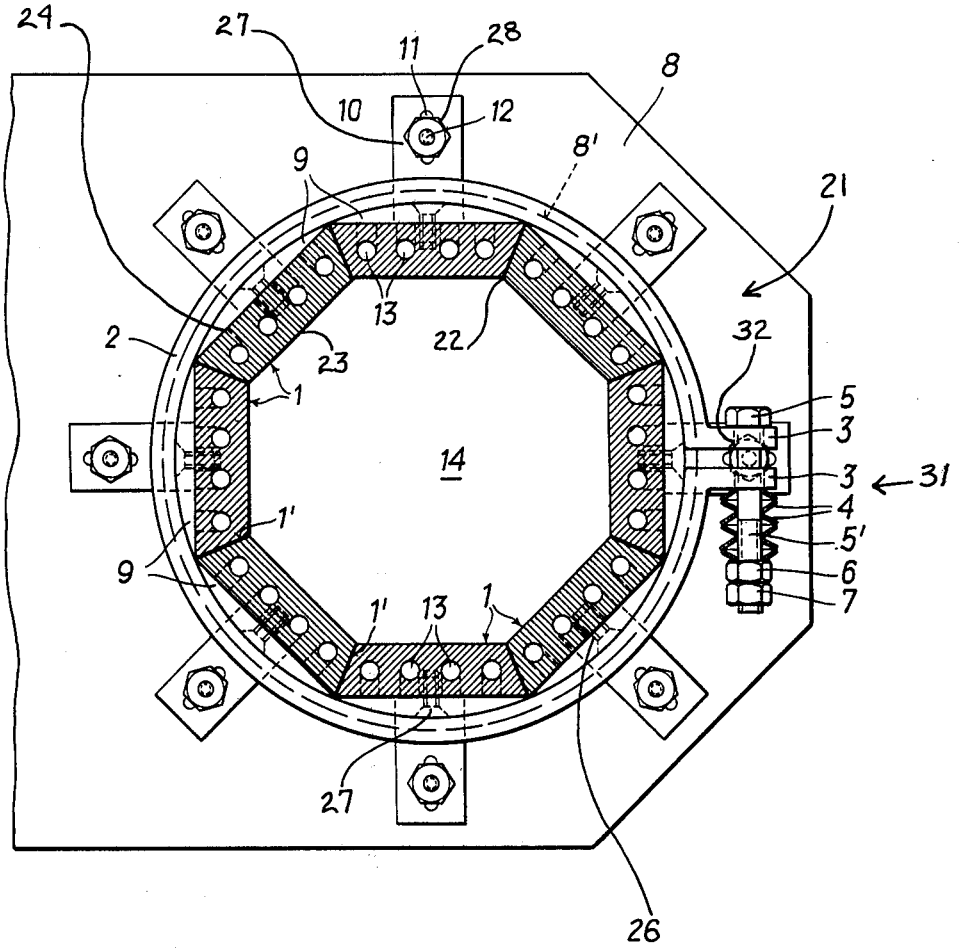
24
27
11
28
8
10
12
8'
9
21
13
22
2
23
32
1
5
3
14
3
31
4
1'
5'
9
6
7
1'
13
1
27
26

Fischer

[11] 4,002,317

[45] Jan. 11, 1977

[54] CASTING MOLD ASSEMBLY

[75] Inventor: Ernst Fischer, Vienna, Austria

[73] Assignee: Gebr.Boehler & Co. Aktiengesellschaft, Vienna, Austria

[22] Filed: Jan. 30, 1975

[21] Appl. No.: 545,437

[30] Foreign Application Priority Data

Feb. 6, 1974 Germany ..... 2405598

[52] U.S. Cl. ..... 249/79; 249/164

[51] Int. Cl.[2] ..... B22D 27/04; B41B 11/46

[58] Field of Search ..... 249/164, 166, 167, 48, 249/49, 185, 186, 173, 194, 17, 165, 143, 24, 160, 161, 162, 79, 80, 155, 158; 24/21, 256, 255 C, 257 R; 269/41, 78, 228

[56] References Cited

UNITED STATES PATENTS

| | | | |
|---|---|---|---|
| 848,091 | 3/1907 | Dunmore | 249/161 |
| 1,000,213 | 8/1911 | Trimble | 249/164 |
| 1,134,051 | 3/1915 | Long et al. | 249/164 |
| 1,154,998 | 9/1915 | Meyer | 249/156 X |
| 1,362,517 | 12/1920 | Stuart et al. | 24/256 |
| 1,652,056 | 12/1927 | Selway | 249/24 |
| 1,657,011 | 1/1928 | Joslin | 249/164 X |
| 1,678,622 | 7/1928 | Horne | 24/256 |
| 1,792,581 | 2/1931 | Firth | 249/166 X |
| 2,595,059 | 4/1952 | Deming | 24/279 |
| 3,071,835 | 1/1963 | Tumey | 249/155 X |
| 3,289,257 | 12/1966 | Richards | 249/79 X |
| 3,865,534 | 2/1975 | Mori | 249/219 R |

FOREIGN PATENTS OR APPLICATIONS

| | | | |
|---|---|---|---|
| 461,135 | 2/1937 | United Kingdom | 249/164 |

*Primary Examiner*—Francis S. Husar
*Assistant Examiner*—John S. Brown

[57] ABSTRACT

A casting mold assembly is provided with improved facilities for preventing the generation of cleavages at the joints of successive plates that are arranged in a closed path about the mold axis to define the central mold cavity. A securing ring tightly engages the outer surface of the plates with the aid of a spring-loaded compression assembly, wherein a pair of spaced parallel legs that terminate the ring are forcibly pressed together by means of a disc spring that is mounted on the shaft of a threaded member and that is captured between the outer surface of one of the ring legs and a threaded nut that cooperates with the shaft. The resultant tightening of the joints between the plates that form the mold wall forms an impenetrable seal to prevent leakage of slag and other residues resulting from hot melts within the mold cavity.

6 Claims, 1 Drawing Figure

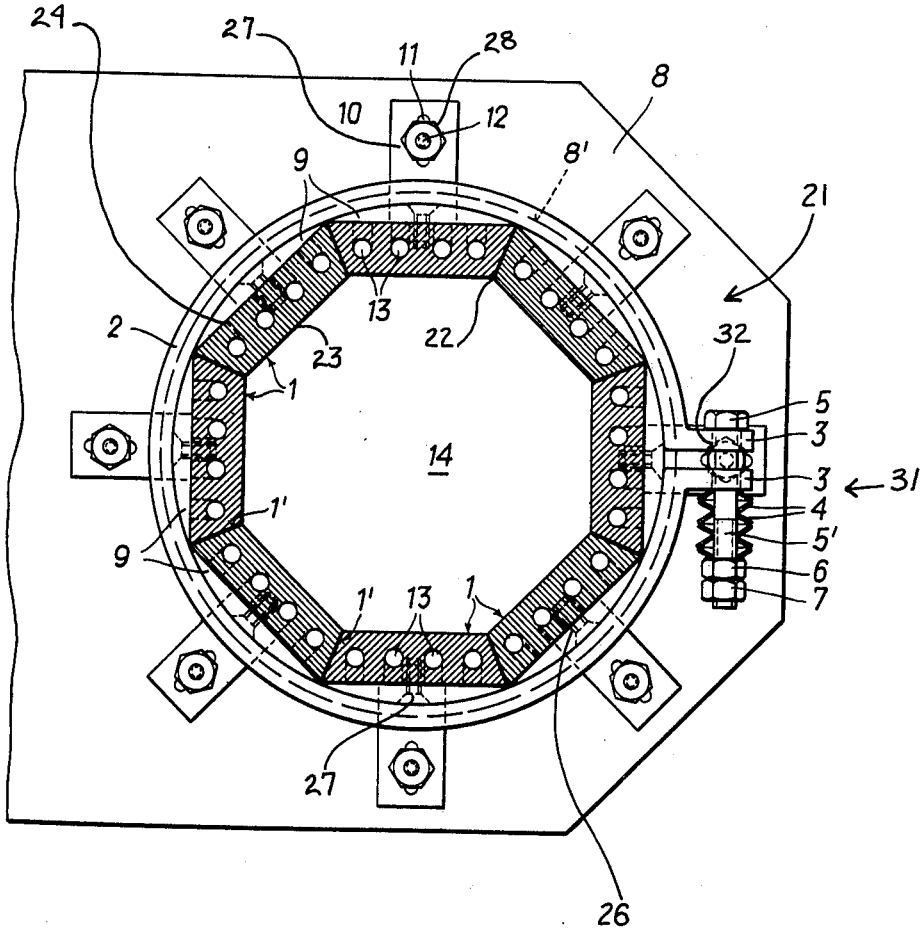

CASTING MOLD ASSEMBLY

BACKGROUND OF THE INVENTION

Conventional casting mold assemblies frequently include a succession of abutting plates that are arranged in a closed path, usually a square or rectangular path, to externally bound a central mold cavity in which hot melt can be poured.

In order to secure the successive plates to each other, it is common (particularly in applications where the mold is not cooled by an external fluid), that the joints between adjacent plates are reinforced either by screw connections or with the aid of a securing ring disposed around the outer periphery of the mold wall.

In the past, when attempts have been made to adapt mold assembly designs of this type to applications requiring external fluid cooling, the joints between the adjacent plates in the mold wall have tended to develop cleavages or splits, particularly during the cooling of hot melts such as steel within the mold cavity. Such faults are irreparable and permanent, and lead to the subsequent leakage of hot metallic melts and/or slag.

SUMMARY OF THE INVENTION

Such disadvantage is effectively overcome by the use of an improved segmented mold assembly of the present invention, which is ideally suited for use in an electroslag remelting process and is particularly adaptable to the sealing of mold joints with the aid of a surrounding sealing ring.

In an illustrative embodiment, the securing ring terminates in a pair of parallel spaced legs which extend transverse to the circumference of the ring. A threaded member, illustratively a hexagonal bolt, extends through both legs of the ring, and a disc spring is supported on the member shaft with one end in abutting relation with the outer surface of one of the ring legs. A threaded hexagonal nut or other suitable member carried on the shaft in abutting relation with the other end of the disc spring compresses the legs of the ring to tighten the ring and to effectively seal the joints between the successive plates of the mold assembly to prevent splits and cleavages of the above-mentioned type.

Preferably, the mold assembly formed by the abutting plates is situated within a central aperture of a mold assembly support member that is provided with a plurality of mounting holes. A corresponding plurality of angle members have first legs secured to spaced portions of the mold wall and second legs which are provided with radial slots that receive set screws disposed in the mounting holes of the support member. In this way, a limited radial movement of the mold wall with respect to the support member is provided to allow for heat expansion of the mold assembly.

The individual plates making up the mold wall may include identical, substantially trapezoidal elements whose inner surfaces are preferably planar and whose outer surfaces are either directly curved themselves or are provided with a suitably curved transition piece so that the resulting outer surface of the mold wall has a curvature that is complementary to the mating curved surface of the securing ring.

BRIEF DESCRIPTION OF THE DRAWING

The invention is further set forth in the following detailed description taken in conjunction with the appended drawing, in which the single figure is a plan view of a segmented mold assembly constructed in accordance with the invention.

DETAILED DESCRIPTION

Referring now to the drawing there is depicted a conventional mold housing assembly 8 that is provided with a central bore 8' which is assumed to axially extend in a direction into the plane of the drawing.

Disposed coaxially within the aperture 8' of the housing 8 is a casting mold assembly 21 constructed in accordance with the invention. The assembly 21 includes a plurality of metallic plates 1—1 of trapezoidal cross section, which are arranged successively around the axis of the mold assembly in a closed path to define a polygonal mold cavity 14. In the illustrative embodiment shown, eight of the plates 1 are employed, so that the mold cavity 14 is octagonal in shape.

Each of the plates 1, which may be constructed of copper, is provided with oblique side walls 1'—1', which cooperate with the corresponding oblique walls of the next successive one of the plates to form a plurality of joints 22—22 which form the points of intersection of the various subsections of the mold cavity 14. Each plate 1 is assumed to extend longitudinally in a direction into the plane of the drawing and is provided with a planar inner surface 23 and a planar outer surface 24.

The joints 22 in the mold wall resulting from the above-mentioned abutting of the individual plates 1—1 may be tightened with the use of a steel securing ring 2 which is disposed around the circumference of the mold wall. In order to provide a better surface of contact between the individual plates 1 and the surrounding ring 2 a plurality of transition pieces 9—9, which are preferably cast, are secured to the outer surfaces 24 of the plates 1. Such transition pieces have a planar inner surface in contact with the outer surface 24 of the plate and a convexly curved outer surface complementary to the concavely curved inner surface of the ring 2. (It will be understood that integral plates having a curved outer surface may be employed in place of the composite assembly of the illustrated plate 1 and transition member 9, if desired).

A plurality of fluid channels 13—13 are axially disposed in each of the plates 1 for carrying a cooling fluid to aid in the setting of the melt (not shown) to be poured into the mold cavity 14. Such channels 13 conventionally communicate with inlet and outlet ports (not shown) disposed on the outer surface of the mold wall.

The mold assembly 21 is secured to the surrounding support member 8 by means of a plurality of circumferentially spaced angle members 10—10. First legs (not shown) may be conventionally secured to the outer surface of the mold wall by means of screws 26—26. Second legs 27—27 of such angle members are secured to the support member 8 by means of set screws 12—12 and cooperating nuts 28—28. In order to provide for heat expansion of the mold assembly 21, the set screws 11 may be disposed within elongated radial slots 11—11 disposed in the legs 27.

It will be evident that when hot melt introduced into the mold cavity 14 cools, stresses will be set up at the joints 22—22 therein. In accordance with the invention, such joints are maintained in a tight condition to prevent splits and cleavages therein by associating with the ring 2 a novel compressive tightening assembly 31.

The ring 2, rather than being continuous, terminates in a pair of parallel, spaced legs 3—3 which have aligned apertures 32—32 therein. The shaft of a threaded bolt 5, illustratively a hexagonal bolt 5, extends through the aligned apertures 32 in the legs 3 to receive one or a plurality of disc springs 4—4. One end of the spring 4 rests against the outer surface of an adjacent one of the legs 3, while the other end of the spring is contacted by a hexagonal nut 6 which cooperates with the threads on the bolt 5 and which is run in on the shaft to a degree appropriate to significantly compress the intermediate disc spring 4. Because the restoring force of the spring 4 may normally tend to loosen the nut 6, second securing hexagonal nut 7 is run in on the shaft of the bolt 5 to secure the nut 6. With such arrangement, any desired degree of compression can be maintained on the legs 3—3, thereby tightening the ring 2 to a desired degree around the mold wall and forming an extremely tight seal at the joints 22 between the adjacent plates 1. Because of the resulting tightness of the joints, no cleavages are formed in the joint area to permit leakage of hot melt or slag during subsequent molding operations.

In the foregoing, the invention has been described in connection with an illustrative embodiment thereof. Many variations and modifications will now occur to those skilled in the art. It is accordingly desired that the scope of the appended claims not be limited to the specific disclosure herein contained.

What is claimed is:

1. In a liquid-cooled casting mold assembly, a plurality of elongated plates successively arranged in a closed path about a mold axis to define a mold wall whose internal surfaces define a central mold cavity of regular polygonal cross section, each plate having a planar outer surface and exhibiting at least one bore extending axially therethrough for passage of the cooling liquid, the adjoining surfaces of the successive plates in the mold wall being disposed in abutting relation, and a securing ring extending around the outer periphery of the mold wall, the ring terminating in a pair of spaced parallel legs extending transverse to the circumference of the ring, a threaded member having a shaft extending through both legs of the ring, spring means positioned on the shaft and having one end disposed in abutting relation with the outer surface of one of the legs of the ring, means carried by the shaft in abutting relation with the other end of the spring means for compressing the legs of the ring toward each other to tightly secure the joints between the successive plates of the mold wall, and a transition member having an inner surface coextensive with and mating with the outer surface of the respective plates and an outer surface which abuts the inner surface of the securing ring and has a curvature that is complementary thereto.

2. A mold assembly as defined in claim 1, in which the spring means is a disc spring.

3. A mold assembly as defined in claim 1, in which the compressing means comprises at least one threaded nut cooperating with the shaft.

4. A mold assembly as defined in claim 1, in which the plates of the mold wall have identical, substantially trapezoidal cross sections with oblique edges, an oblique edge of each plate cooperating with the oblique edge of the adjacent plate to form one angle in the cross section of the polygonal mold cavity.

5. A mold assembly as defined in claim 1, in which the mold assembly further comprises, in combination, a support member having a central aperture for coaxially receiving the mold wall, and a plurality of angle members individually associated with each plate, a first leg of each angle member being secured to the associated plate and a second leg of each angle member being movably attachable to the support member, each second leg exhibiting an elongated slot extending radially to the mold axis.

6. A mold assembly as defined in claim 5, further comprising a plurality of screws individually extending through the respective radial slots for securing the second legs to the support member.

* * * * *